US005707209A

United States Patent [19]

Iyer et al.

[11] Patent Number: 5,707,209

[45] Date of Patent: Jan. 13, 1998

[54] CENTRIFUGAL VENTILATOR FAN

[75] Inventors: Vasanthi Iyer, Yardley, Pa.; David DeNofa, Waretown, N.J.

[73] Assignee: Penn Ventilator Co., Inc., Philadelphia, Pa.

[21] Appl. No.: 730,691

[22] Filed: Oct. 11, 1996

[51] Int. Cl.[6] ..... F04D 29/30

[52] U.S. Cl. ..... 416/186 R; 416/189; 416/223 B; 416/235; 416/238; 416/DIG. 2; 416/DIG. 5

[58] Field of Search ..... 416/186 R, 182, 416/185, 189, 192, 223 B, 235, 238, 242, DIG. 2, DIG. 5

[56] References Cited

U.S. PATENT DOCUMENTS

| | | | |
|---|---|---|---|
| 743,869 | 11/1903 | Hedlund | 416/185 |
| 751,315 | 2/1904 | Lindmark | 416/185 |
| 819,079 | 5/1906 | Parvis . | |
| 1,143,082 | 6/1915 | Shepherd et al. . | |
| 1,341,882 | 6/1920 | Criqui . | |
| 1,637,652 | 8/1927 | Ness . | |
| 2,201,947 | 5/1940 | Valentine . | |
| 3,179,329 | 4/1965 | Dybvig . | |
| 3,221,398 | 12/1965 | Mayne . | |
| 3,260,443 | 7/1966 | Garnett et al. . | |
| 3,368,744 | 2/1968 | Jenn | 416/186 R |
| 3,507,581 | 4/1970 | Jensen . | |
| 3,846,043 | 11/1974 | Wolbrink et al. . | |
| 4,165,950 | 8/1979 | Masai et al. . | |
| 4,172,691 | 10/1979 | Comstock et al. . | |
| 4,543,041 | 9/1985 | French et al. . | |
| 4,946,348 | 8/1990 | Yapp . | |
| 5,221,187 | 6/1993 | Lorea et al. | 416/189 |
| 5,336,050 | 8/1994 | Guida et al. | 416/186 R |

FOREIGN PATENT DOCUMENTS

| | | | |
|---|---|---|---|
| 0132499 | 10/1981 | Japan | 416/223 B |
| 0211795 | 11/1984 | Japan | 416/186 R |
| 0676760 | 7/1979 | U.S.S.R. | 416/186 R |
| 0987194 | 1/1983 | U.S.S.R. | 416/186 R |
| 0817707 | 8/1959 | United Kingdom | 416/242 |

*Primary Examiner*—Christopher Verdier
*Attorney, Agent, or Firm*—Panitch Schwarze Jacobs & Nadel, P.C.

[57] ABSTRACT

A centrifugal ventilator fan having a base plate with an axis of rotation, an inlet ring having an opening therethrough and a plurality of generally flat blades, each having first and second side edges, a leading edge and a trailing edge is provided. Each blade is connected to the base plate along the first side edge, and is connected to the inlet ring along the second side edge. The blades are radially spaced about the axis of rotation and are backwardly inclined with respect to a direction of rotation of the fan. A portion of each blade adjacent to the leading edge has a radius of curvature such that the blade portion adjacent to the leading edge extends generally inwardly towards the axis of rotation to reduce noise generated by the ventilator fan.

13 Claims, 4 Drawing Sheets

CENTRIFUGAL VENTILATOR FAN

FIELD OF THE INVENTION

The present invention relates to ventilator fan devices, and more particularly, to centrifugal ventilator exhaust fans.

BACKGROUND OF THE INVENTION

Exhaust ventilators with centrifugal fan blades are generally known in the art. Typically, these fans operate at low static pressure, with air entering axially through an inlet and being discharge radially through openings in the ventilator housing. One problem with the known ventilator fan designs is that the fans often produce a high noise level based on the turbulence created by turning the air flow from the axial inlet to the radial direction for discharge. While certain tradeoffs based on the speed of the fan, the fan size and the required volumetric air flow are expected, there has been a constant need to reduce the noise produced by such ventilator fans without significantly sacrificing fan performance.

In one known ventilator fan design, the blades are designed with a tapered leading edge with the surfaces of each blade being formed partially by truncated cones. The leading edges of the blades are curved forward in the direction of rotation to catch the air flow, and the trailing edges of the blades are curved in a direction opposite to the direction of rotation of the fan to allow the air to flow off the ends of the blades. In another known blower wheel design, the blades are formed from sheet metal and each also includes a curved inner tip on the leading edge which catches the air flow, and is therefore curved in the direction of rotation.

U.S. Pat. No. 5,336,050 which is assigned to the assignee of the present invention, and is incorporated by reference as if fully set forth, also discloses a ventilator fan having arcuate blades formed from sheet metal which are backwardly inclined with respect to the direction of rotation of the fan.

The present invention is a result of observation of the limitations of the known fans and efforts to provide a centrifugal ventilator fan which generates reduced noise in comparison to the known designs while still providing a high volumetric air flow.

SUMMARY OF THE INVENTION

Briefly stated, the present invention provides a centrifugal ventilator fan having a base plate with an axis of rotation, an inlet ring having an opening therethrough and a plurality of generally flat blades. Each blade has first and second side edges, a leading edge and a trailing edge. Each blade is connected to the base plate along at least a portion of the first side edge, and is connected to the inlet ring along at least a portion of the second side edge. The blades are radially spaced about the axis of rotation and are backwardly inclined with respect to a direction of rotation of the fan. A portion of each blade adjacent to the leading edge has a radius of curvature such that the blade portion adjacent to the leading edge extends generally inwardly towards the axis of rotation to reduce noise generated by the ventilator fan.

In another aspect, the present invention provides a centrifugal ventilator fan having a base plate with an axis of rotation, an inlet ring having an opening therethrough, and a plurality of generally flat blades. Each blade has first and second side edges, a leading edge and a trailing edge. Each blade is connected to the base plate along at least a portion of the first side edge, and is connected to the inlet ring along at least a portion of the second side edge. The blades are radially spaced about the axis of rotation and backwardly inclined with respect to a direction of rotation of the fan. A portion of each blade adjacent to the leading edge has a radius of curvature such that the blade portion adjacent to the leading edge extends generally inwardly towards the axis of rotation. Each blade has a chord length between the leading and trailing edges defined as $C_L$, a thickness defined as t, and a radius of curvature of the leading edge defined as R, which satisfies the equations:

$$H=(R/24)(R/R_1)^2(12-(R/R_1)^2)$$

$$2<C_L/H<\infty$$

where $R_1$ =R+t/2, and $C_L$/H is the radius coefficient, for a flow coefficient of between approximately 0.1 to 0.5 where the flow coefficient is defined by the equation:

$$\phi=Q/AU$$

where Q is a volumetric flow rate for air moved by the fan and is between 150 and 3000 cubic feet per minute, A is a peripheral area of the fan, and U is a peripheral velocity of the fan. The radiused portion of each blade reduces noise generated by the ventilator fan.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
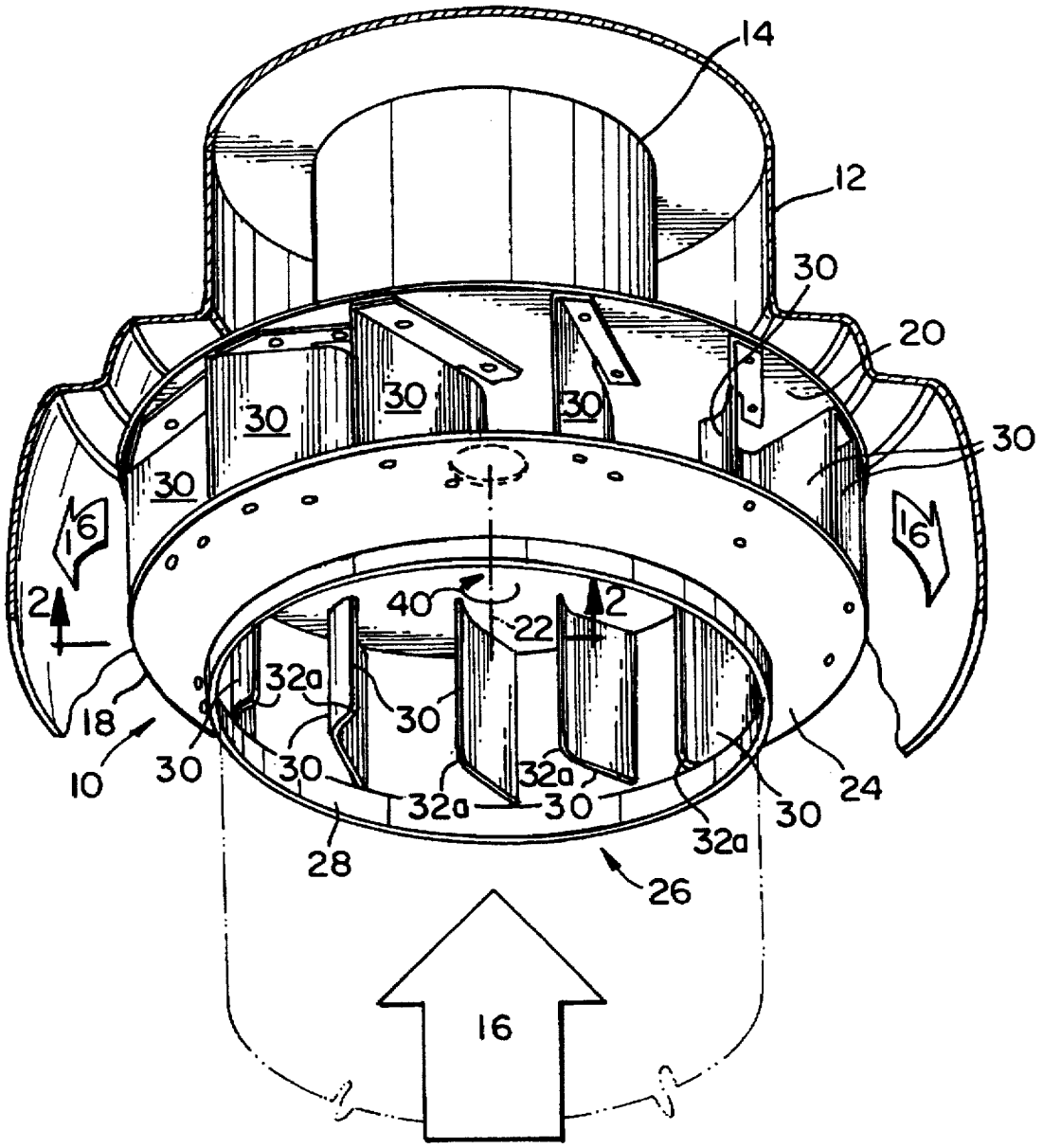
FIG. 1 is a perspective view of a centrifugal ventilator fan in accordance with a first preferred embodiment of the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the centrifugal ventilator fan and designated parts thereof. The terminology includes the words above specifically mentioned, derivatives thereof and words of similar import.

Referring to the drawings, wherein like numerals indicate like elements throughout, there is shown in FIG. 1–6 centrifugal ventilator fan 10 in accordance with a first preferred embodiment of the invention. As shown in FIG. 1, the centrifugal ventilator fan 10 comprises a housing 12, a motor 14 located in the housing 12, and a fan blade assembly 18. Air, represented by flow arrow 16, is drawn axially into the centrifugal ventilator fan 10 and is forced radially outwardly by the fan blade assembly 18 through an opening in the housing 12.

Figure 2:
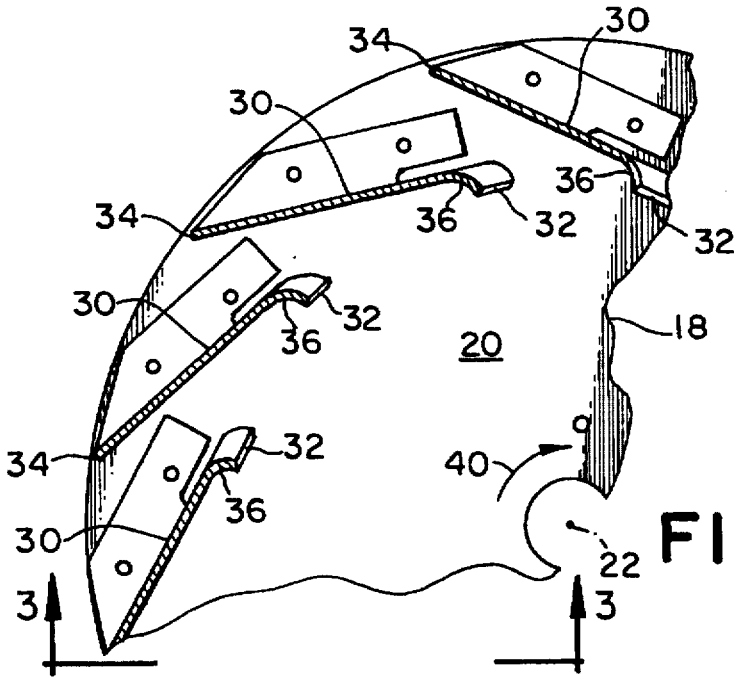
FIG. 2 is a partial cross-sectional view taken along lines 2—2 of FIG. 1.
Figure 3:
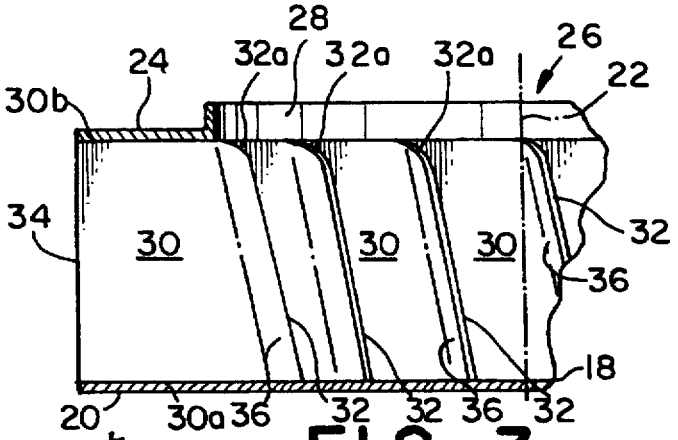
FIG. 3 is a partial cross-section view taken along line 3—3 of FIG. 2.

As shown in FIGS. 1–3, the fan blade assembly 18 of the centrifugal ventilator fan 10 includes a base plate 20 having an axis of rotation 22. The fan blade assembly 18 also includes an inlet ring 24 having a central opening 26 extending therethrough. Preferably, an annular, generally inwardly extending flange 28 is formed on the inlet ring 24 around the opening 26. A plurality of generally flat blades 30 are mounted between the base plate 20 and the inlet ring 24.

In the first preferred embodiment 10, the drive shaft of the motor 12 is connected directly to the base plate 20 to rotate the fan blade assembly 18, and the housing 12 is adapted for roof top mounting, such that exhaust air 16 can be drawn upwardly from an enclosed space by the fan 10 and forced radially outwardly through openings in the housing 12. However, it will be recognized by those skilled in the art that the fan 10 can be adapted for other types of mounting arrangements, or may be used to force air through a duct system, if desired. Additionally, the fan blade assembly 18 may be driven by other means, such as a belt or gear drive, in order to allow the motor 14 to be mounted separately from the housing 12 and to provide different turning speeds for the fan blade assembly 18 through the use of step-up or step-down pulleys, gears or other motion connecting devices (not shown), if desired.

Referring now to FIGS. 2–6, the fan blades 30 each have first and second side edges **30*a*, 30*b*, a leading edge 32 facing the axis 22 and a trailing edge 34 facing the housing 12. Each blade 30 is connected to the base plate 20 along a portion of the first side edge 30*a*, and is connected to the inlet ring 24 along a portion of the second side edge 30*b*. The blades 30 are generally equally radially spaced from each other about the axis of rotation 22 and are backwardly inclined with respect to a direction of rotation of the fan, represented by arrow 40. In the preferred embodiment, there are ten to twelve blades 30, and more preferably, twelve blades 30**, as shown. However, it will be understood by those skilled in the art from the present disclosure that the number of blades can be varied, and there may be more or less blades depending on factors such as the volume of air flow required and others.

Figure 4:
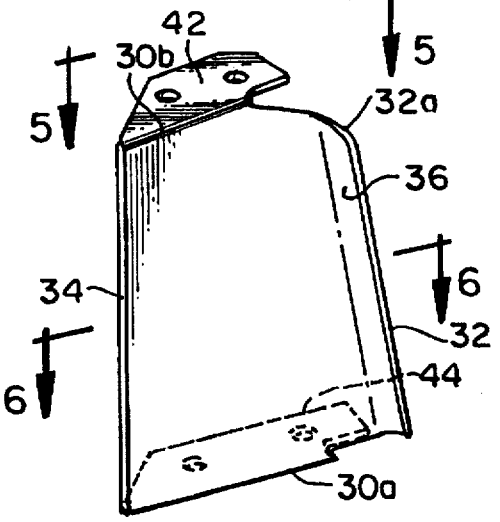
FIG. 4 is a perspective view of a single blade in accordance with a first preferred embodiment of the present invention.
Figure 5:
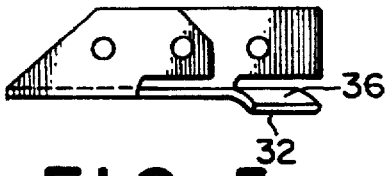
FIG. 5 is a top plan view of the blade of FIG. 4, taken along line 5—5 of FIG. 4.

As shown in FIGS. 2, 4 and 5, in the first embodiment of the centrifugal ventilator fan 10, each blade 30 includes an upper flange 42 and a lower flange 44 which are used to attach the fan blades 30 to the inlet ring 42 and the base plate 20 respectively. Preferably, the blades 30 are attached with mechanical fasteners, such as rivets, screws, bolts or the like. However, it will be recognized by those skilled in the art from the present disclosure that other attachment means, such as adhesive or other bonding or welding could be used, if desired. Additionally, the flanges 42, 44 could be omitted depending upon the assembly procedure and method and the fixtures used to position the blades 30 prior to attaching them in position by a method such as welding.

Figure 6:
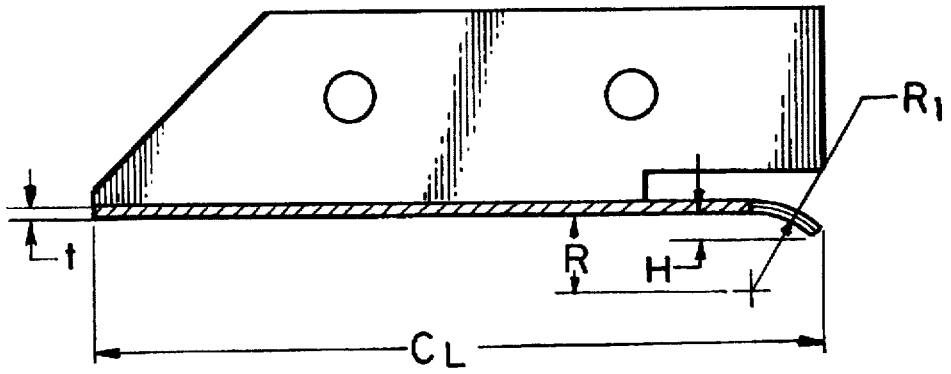
FIG. 6 is a cross-sectional view of the blade taken along line 6—6 of FIG. 4.

Referring again to FIGS. 1–6, a portion 36 of each blade 30 adjacent to the leading edge 32 has a radius of curvature such that the blade portion 36 adjacent to the leading edge 32 extends generally inwardly toward the axis of rotation 22 to reduce the noise generated by the ventilator fan 10. As indicated in FIG. 6, the radius of curvature of the leading edge 32 is indicated as R. Each blade 30 has a chord length, indicated as $C_L$, between the leading and trailing edges 32, 34. The chord length $C_L$ of each blade 30 preferably decreases from the base plate 20 toward the inlet ring 24. Each blade has a thickness, indicated as t, and a height of the leading edge 32 from the generally flat portion of the blade 30, indicated as H. A radius coefficient $C_L/H$ for each blade 30 satisfies the equations:

$$H=(R/24)(R/R_1)^2(12-(R/R_1)^2 \quad \text{(Equation 1)}$$

$$2<C_L/H<\infty \quad \text{(Equation 2)}$$

where $R_1=R+t/2$.

In the first preferred embodiment 10, the radius of curvature R and chord length $C_L$ are defined such that the radius coefficient $C_L/H$ is between approximately 5 and 50, and more preferably between 5 and 15. The optimum fan performance was achieved with a radius coefficient $C_L$ of between 8 and 11. This provides a reduced noise level by the fan 10 due to the radius of curvature on the blade portion 36 adjacent to the leading edge 32, with an increase in air flow in comparison to a flat blade.

In the first preferred embodiment, the fan 10 has a flow coefficient of between approximately 0.1 to 0.5, where the flow coefficient is defined by the equation:

$$\phi=Q/AU \quad \text{(Equation 3)}$$

Q is a volumetric flow rate for air moved by the fan 10, and is preferably between 150 and 3000 cubic feet per minute, A is a peripheral area of the fan 10 which is calculated by multiplying the fan circumference by the blade height, and U is a peripheral velocity of the fan 10. However, improved performance and reduced noise levels are also realized at higher and lower flow rates through the use of blades 30 having a radiused portion 36 adjacent to the leading edge 32.

Preferably, in the first preferred embodiment 10, the leading edge 32 of each blade 30 includes a radiused relief **32*a* adjacent to the opening 26 in the inlet ring 24, as shown in FIGS. 1 and 3. However, it will be recognized by those skilled in the art from the present disclosure that the radiused relief 32*a*** may be omitted, if desired.

Preferably, the base plate 20, the inlet ring 24 and the blades 30 are made of aluminum or an aluminum alloy, with the base plate 20 being approximately 0.060–0.080 inches thick and the blades 30 and inlet ring 24 being made from approximately 0.040–0.0625 inches thick material. However, it will be recognized by those skilled in the art from the present disclosure that the material and thickness of the base plate 20, inlet ring 24 and blades 30 could be varied depending upon the size of the centrifugal ventilator fan 10. For example, the base plate 20, inlet ring 24 and blades 30 could be made of any type of sheet metal polymeric material, composite or the like, depending upon the particular application, and the thickness of the material could be varied accordingly.

Three fans in accordance with the first preferred embodiment 10 were tested for performance along with a similarly configured fourth fan with flat blades. The blades 30 for all of the fans were approximately four inches tall with a maximum chord length of 2.88 inches at the first edge 30*a* and a radius relief 32*a* of 1.0 inches on the leading edge 32 adjacent to the inlet ring 24. The chord length $C_L$ decreased from the first side edge 30*a* toward the second side edge 30*b* based on a constant leading edge taper of about 9.75°. The radius of curvature R for the blade portion 36 adjacent to the leading edge 32 for the blades 30 of each of the four fans which were tested were 0.75 in., 0.313 in., 0.13 in., and 0.0 in. The height H was determined according to Equation 1 above based on each radius of curvature R and a thickness t of 0.050. The blades 30 were mounted to a base plate 20 having a diameter of 9.875 inches and the blade assemblies 18 were rotated at 1550 rpm.

Figure 9:
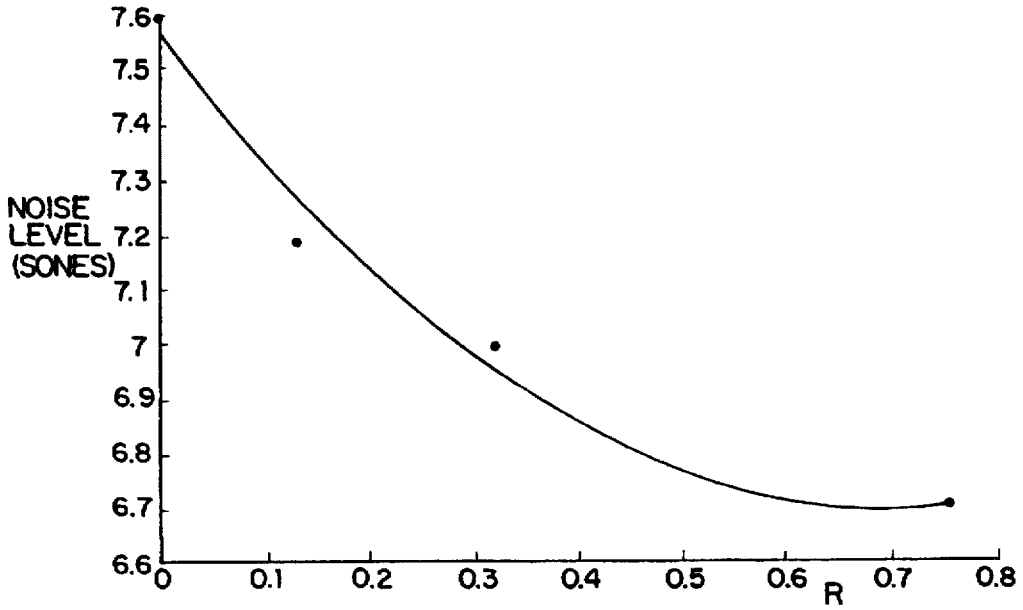
FIG. 9 is a graph showing the relation between noise level and leading edge radius for a fan in accordance with the first preferred embodiment of the invention.
Figure 10:
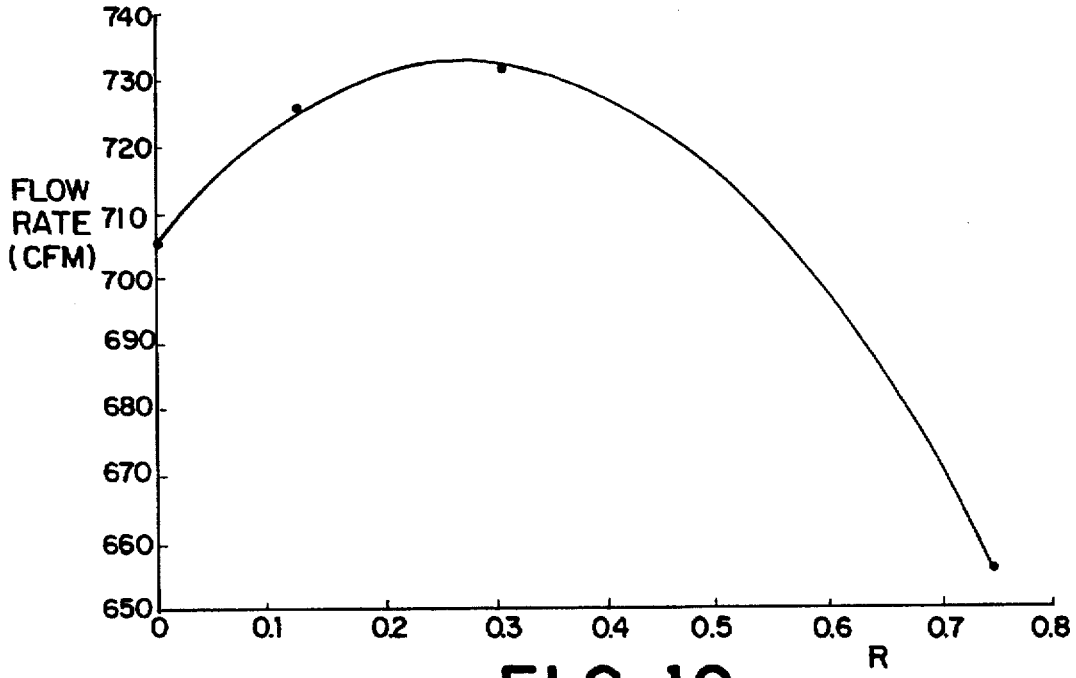
FIG. 10 is a graph showing the relationship between flow rate and leading edge radius for the fan in accordance with the first preferred embodiment of the invention.

Two graphs are shown in FIGS. 9 and 10 which show data obtained as a result of testing the fans described above. As can be seen from FIG. 9, the noise level decreased as the radius of curvature R increased from 0 to 0.8, from a maximum of approximately 7.57 sones for the flat blades to a minimum of approximately 6.7 sones. A sone is defined as the loudness of a sound with a frequency of 1,000 Hz and a sound pressure of 0.02 microbars (40 dB), and generally a noise level of 7.1 sones or less is considered to be acceptable. Sones were calculated by the method defined in ANSI S 3.4-1980.

Referring to FIG. 10, the flow rate in cubic feet per minute increased from approximately 706 cubic feet per minute (cfm) for the flat blade to a maximum of approximately 732 cfm for the blades having a radius of curvature R of 0.3 inches and then decreased as the radius of curvature R of the blades increased. While optimum performance was obtained with blades having a radius of curvature R at the leading edge 32 of approximately 0.3 inches with an acceptable noise level of approximately 7 sones, reduced noise levels can be achieved through a trade off in fan performance. Based on the acceptability of a noise level of under 7.1, an optimum configuration for the radius of curvature R of the blades would be a radius of approximately 0.3 inches, with further reductions in noise level down to 6.75 sones being possible while achieving an equivalent air flow to the flat bladed fan.

Based on the above data and additional testing, the best fan performance based on volumetric air flow with acceptable noise levels of 7.1 sones or less is achieved when the radius coefficient $C_L/H$ is between 5 and 15, and more preferably, between approximately 8 and 11.

Figure 7:
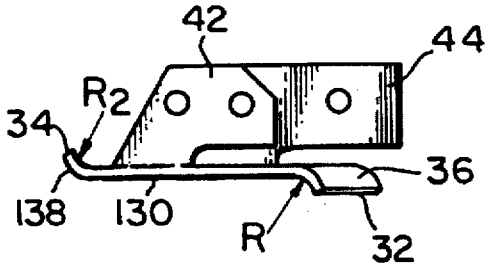
FIG. 7 is a top plan view similar to FIG. 5 of a blade in accordance with a second preferred embodiment of the invention.

Referring now to FIG. 7, a blade 130 for a second embodiment of a centrifugal ventilator fan is shown. The second embodiment of the centrifugal ventilator fan is identical to the first embodiment 10, except for the blade configuration. The blade 130 is similar to the blade 30 of the first embodiment, and like elements have been identified with the same reference numerals.

The blade 130 is generally flat, and includes the portion 36 adjacent to the leading edge having a radius of curvature R. The blade 130 also includes a portion 138 adjacent to the trailing edge 34 which includes a radius of curvature R2. The curved blade portion 138 adjacent to the trailing edge 34 extends generally outwardly, in an opposite direction from the curved blade portion 36 adjacent to the leading edge 32.

Based on experimental testing, the second embodiment of the fan with blades 130 having the curved portion 138 adjacent to the trailing edge 34 further reduces noise level. Two centrifugal ventilator fans having a base plate with a diameter of 11.0 in. with the radius of curvature of R at the leading edge of 0.75 inches were tested at 1550 rpm. One fan also included a curved portion 138 adjacent to the trailing edge 34 having a radius R2 of 0.75 in. with a height at the trailing edge of −0.057 in. The sound level produced by the centrifugal ventilator fan with the curved portion 138 adjacent to the trailing edge 34 was 6.6 sones for an air flow of 860 cfm. The fan having a blade without the curved portion 138 adjacent to the trailing edge 34 produced a noise level of 8.8 sones for an air flow of 864 cfm. This is a significant improvement in noise level with only a nominal difference in volumetric air flow.

Figure 8:
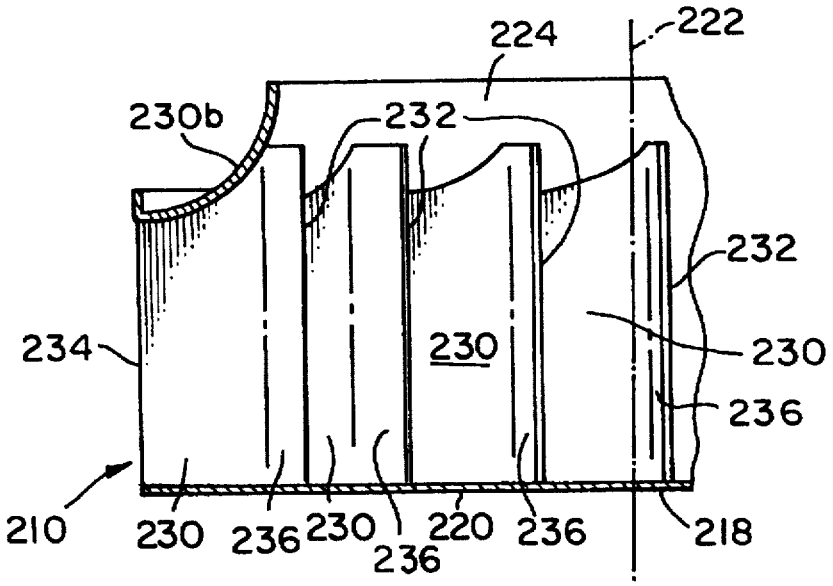
FIG. 8 is a cross-sectional view similar to FIG. 3 of a centrifugal ventilator fan in accordance with a third preferred embodiment of the invention.

Referring now to FIG. 8, a third embodiment of the centrifugal ventilator fan 210 is shown. The third embodiment of the ventilator fan 210 is similar to the first embodiment 10 and similar reference numerals with the prefix 2 have been used to identify like elements. The differences between the third embodiment of the centrifugal ventilator fan 210 and the first embodiment 10 are described in detail below.

As shown in FIG. 8, the inlet ring 224 is curved and the second side edge 230*b* of each blade 230 is curved to match the curvature of the inlet ring 224. Additionally, the radius relief on the leading edge 232 has been omitted. Preferably, the blades 230 are assembled to the curved inlet ring with welds. Positioning holes may be provided in the inlet ring 224 and tabs may be located on the second side edge 230*b* of the blade 230 in order to properly align the inlet ring 224, in a similar manner to that described in U.S. Pat. No. 5,336,050, which is incorporated herein by reference as if fully set forth. The portion 236 of each blade 230 adjacent to the leading edge 232 similarly includes a radius of curvature with the leading edge 232 extending generally inwardly toward the axis of rotation 222 to reduce noise generated by the ventilator fan 210. Again, optimal fan performance was achieved when the radius 420 coefficient $C_L h$ was between 5 and 15 and more preferably when the radius coefficient was between 8 and 11.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A centrifugal ventilator fan comprising:

a base plate having an axis of rotation;

an inlet ring having an opening therethrough;

a plurality of generally flat blades, each blade having first and second side edges, a leading edge and a trailing edge, each blade being connected to the base plate along at least a portion of the first side edge, and being connected to the inlet ring along at least a portion of the second side edge, the blades being radially spaced about the axis of rotation and backwardly inclined with respect to a direction of rotation of the fan, a portion of each blade adjacent to the leading edge having a radius of curvature such that the blade portion adjacent to the leading edge extends generally inwardly toward the axis of rotation to reduce noise generated by the ventilator fan, each blade having a chord length $C_L$ between the leading and trailing edges, a thickness t, height H of the leading edge from the generally flat blade, and the radius of curvature R of the leading edge, and a radius coefficient $C_L/H$ for each blade satisfies the equations:

$$H=(R/24)(R/R_1)^2(12-(R/R_1)^2)$$

$$2<C_L/H<\infty$$

where $R_1=R=t/2$.

2. The centrifugal ventilator fan of claim 1 wherein the fan has a volumetric airflow of 150 to 3000 cubic feet per minute.

3. The centrifugal ventilator fan of claim 1 wherein the radius of curvature and chord length are defined such that the radius coefficient is between approximately 5 and 15.

4. The centrifugal ventilator fan of claim 1 wherein a portion of each blade adjacent to the trailing edge includes a radius of curvature such that the blade portion adjacent to the trailing edge extends generally outwardly, in an opposite direction from the curved portion of the blade adjacent to the leading edge.

5. The centrifugal ventilator fan of claim 1 wherein each blade has a chord length between the leading and trailing edges, and the chord length of each blade decreases from the base plate toward the inlet ring.

6. The centrifugal ventilator fan of claim 1 wherein each blade includes a radius relief adjacent to the opening in the inlet ring.

7. The centrifugal ventilator fan of claim 1 wherein each blade includes a first flange located along the first side and a second flange located along the second side for attachment of each blade to the base plate and the inlet ring.

8. A centrifugal ventilator fan comprising:

a base plate having an axis of rotation;

an inlet ring having an opening therethrough;

a plurality of generally flat blades, each blade having first and second side edges, a leading edge and a trailing edge, each blade being connected to the base plate along at least a portion of the first side edge, and being connected to the inlet ring along at least a portion of the second side edge, the blades being radially spaced about the axis of rotation and backwardly inclined with respect to a direction of rotation of the fan, a portion of each blade adjacent to the leading edge having a radius of curvature such that the blade portion adjacent to the leading edge extends generally inwardly toward the axis of rotation, each blade having a chord length $C_L$ between the leading and trailing edges, a thickness t, a height H of the leading edge from the generally flat blade, and the radius of curvature R of the leading edge, and a radius coefficient $C_L/H$ for each blade satisfies the equations:

$$H=(R/24)(R/R_1)^2(12-(R/R_1)^2)$$

$$2<C_L/H<\infty$$

where $R_1=R+t/2$, for a flow coefficient of between approximately 0.1 to 0.5 where the flow coefficient is defined by the equation:

$$\phi=Q/AU$$

where Q is a volumetric flow rate for air moved by the fan and is between 150 and 3000 cubic feet per minute, A is a peripheral area of the fan, and U is a peripheral velocity of the fan, the radiused portion of the blades reducing noise generated by the ventilator fan.

9. The centrifugal ventilator fan of claim 8 wherein the radius of curvature and chord length are defined such that the radius coefficient is between approximately 5 and 15.

10. The centrifugal ventilator fan of claim 8 wherein a portion of each blade adjacent to the trailing edge includes a radius of curvature such that the blade portion adjacent to the trailing edge extends generally outwardly, in an opposite direction from the curved portion of the blade adjacent to the leading edge.

11. The centrifugal ventilator fan of claim 8 wherein each blade has a chord length between the leading and trailing edges, and the chord length of each blade decreases from the base plate toward the ring.

12. The centrifugal ventilator fan of claim 8 wherein each blade includes a radiused relief adjacent to the opening in the inlet ring.

13. The centrifugal ventilator fan of claim 8 wherein each blade includes a first flange located along the first side and a second flange located along the second side for attachment of each blade to the base plate and the inlet ring.

* * * * *